US007617572B2

(12) United States Patent
Hovsepian et al.

(10) Patent No.: US 7,617,572 B2
(45) Date of Patent: Nov. 17, 2009

(54) CURVED HANDLE FOR MANUALLY OPERATED IMPLEMENT

(76) Inventors: Justin A. Hovsepian, 55 Monmouth Rd., Oakhurst, NJ (US) 07755; Alexander Hovsepian, 55 Monmouth Rd., Oakhurst, NJ (US) 07755

( * ) Notice: Subject to any disclaimer, the term of this patent is extended or adjusted under 35 U.S.C. 154(b) by 0 days.

(21) Appl. No.: 12/070,266

(22) Filed: Feb. 15, 2008

(65) Prior Publication Data

US 2009/0205165 A1 Aug. 20, 2009

(51) Int. Cl.
*B25G 1/10* (2006.01)

(52) U.S. Cl. ..... 16/436; 15/143.1

(58) Field of Classification Search ..... 16/436, 16/430, 431, 110.1; 15/143.1, 145, 146, 15/159.1; 81/489
See application file for complete search history.

(56) References Cited

U.S. PATENT DOCUMENTS 2,236,123 A * 3/1941 Von Pierce ..... 15/104.068
2,753,579 A * 7/1956 Kussmann ..... 15/145
2,769,999 A * 11/1956 Sheahan ..... 15/327.2
4,809,388 A * 3/1989 Dietrich ..... 15/143.1
5,010,616 A * 4/1991 Berti ..... 15/159.1
5,659,916 A * 8/1997 Beatty et al. ..... 15/210.1
5,791,006 A * 8/1998 Anctil ..... 15/144.4
D413,234 S * 8/1999 Spear ..... D8/13
D433,890 S * 11/2000 Scaringella ..... D8/13
6,203,626 B1 * 3/2001 Biggs et al. ..... 134/6
6,487,747 B2 * 12/2002 Cavalheiro ..... 15/143.1
6,684,459 B2 * 2/2004 Dickhaus ..... 16/430
6,732,671 B2 * 5/2004 Johnson ..... 114/221 R
D579,165 S * 10/2008 Handy et al. ..... D32/40
2003/0145432 A1 * 8/2003 Figura et al. ..... 16/427
2004/0055099 A1 * 3/2004 Greenberg ..... 15/143.1
2004/0244130 A1 * 12/2004 Kim ..... 15/104.94

* cited by examiner

*Primary Examiner*—William L. Miller
(74) *Attorney, Agent, or Firm*—Stuart M. Goldstein

(57) ABSTRACT

A curved handle for a manually operated implement has a straight segment extending from a first curved segment having a uniform radius of curvature and a second curved segment having a different uniform radius of curvature extending from the first segment. The handle has two working ends and a threaded connection on each end for securing various working attachments or members. This multi-use handle can thus be used in implements performing numerous different applications on horizontal, vertical and elevated surfaces.

19 Claims, 6 Drawing Sheets

CURVED HANDLE FOR MANUALLY OPERATED IMPLEMENT

BACKGROUND OF THE INVENTION

The present invention relates to curved handles for manually operated implements such as mops, brooms, paint applicators, reach rods, and a variety of other handheld tools. The invention provides a handle which is not only ergonomically shaped for maximum efficiency, but is also configured to allow cleaning members and other working elements to be attached to either end of the handle for effective use in different cleaning and other functional modes.

Most implement handles are substantially straight in design and, as a result, so are the majority of brooms, mops, applicators and other implements employing elongated handles. Over the years, handles have been provided which contain some degree of curvature, as exemplified by U.S. Pat. Nos. 6,203,626, 6,487,747, U.S. Des. Pat. Nos. D413,234, and 433,890, or more drastic curved configurations which are purportedly designed to enhance appearance or provide the user with an ergonomic advantage, e.g. U.S. Pat. Nos. 2,753,579 and 5,791,006. However, many of these prior art handles do not accomplish the results claimed for the variety of potential users. In addition, such handles are often difficult to manufacture and they are cumbersome when it comes to storage of the implements. Existing handles also do not provide the option of connecting different working attachments at both ends of the handle for efficient and ergonomic use in different use positions.

SUMMARY OF THE INVENTION

It is thus the object of the present invention to provide a curved handle for a manually operated implement which overcomes the disadvantages and limitations of prior products.

It is an object of the present invention to provide a curved handle for a manually operated implement which permits the connection of different attachments to either working end of the handle, to allow efficient, effective, and ergonomic use of the implement in different working modes.

It is a further object of the present invention to provide a curved handle for a manually operated implement which is highly efficient in use regardless of which end of the handle has a working attachment secured thereto.

It is still another object of the present invention to provide a curved handle for a manually operated implement which is easy to manufacture and convenient to store.

It is another object of the present invention to provide a curved handle for a manually operated implement which has two working ends and, as a result, has the flexibility to be used both on horizontal, vertical and elevated surfaces.

It is a further object of the present invention to provide a curved handle for a manually operated implement which assists in relieving the user of the common back strain caused by manual implements with prior art handles.

These and other objects are accomplished by the present invention, a uniquely configured curved handle for manually operated implements. The handle has a straight segment extending to a first curved segment having a uniform radius of curvature and a second curved segment having a different uniform radius of curvature, extending from the first segment. The handle has two working ends and a threaded connection on each end for securing various cleaning or other working members or attachments. This multi-use handle can thus be used in implements performing numerous different applications on horizontal, vertical and elevated surfaces.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
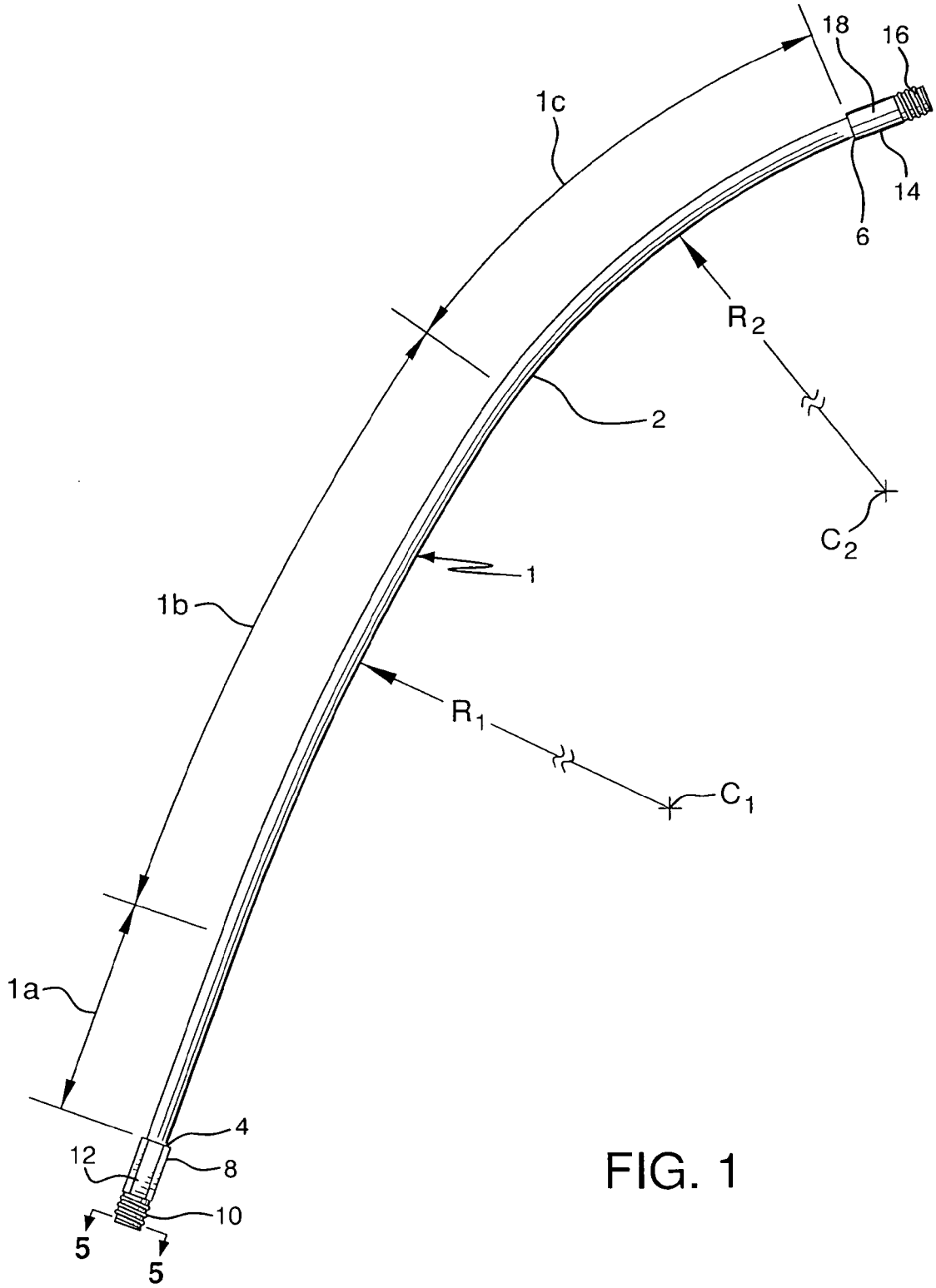
FIG. 1 is an elevation view of the curved handle of the present invention.

Handle 1 of the present invention comprises an integral, solid, unbendable elongated shaft 2 having first working end 4 and second working end 6. Threaded connector 8, with threaded end 10 and multi-sided sleeve 12, is located at end 4 and threaded connector 14, with threaded end 16 and cylindrical sleeve 18, is located at end 6.

Handle 1 can be of a given length of any dimension convenient for use with a manual implement, such as a pushbroom or mop or other working tool, but it has been found that a length, excluding the length of connectors 8 and 14, in the range of fifty to sixty inches to be the most ergonomic.

Significantly, handle 1 has substantially straight segment 1*a*, extending from connector 8 at end 4. Straight segment 1 a has length L which represents @ 15-20% of the overall length of handle 1. The remaining length of handle 1, from the terminus of straight segment 1*a* to connector 14, is a smoothly curved, continuously concave section. This curved section comprises first curved segment 1*b* and second curved segment 1*c*. Curved segment 1*b* extends from the terminus of straight segment 1*a* in a uniform radius of curvature $R_1$ (measured from $C_1$, the center of the circle of $R_1$) for a distance of 40-60% of the overall length of the handle. Segment 1*b* optimally has a uniform radius of curvature of approximately two times the length of the handle. Curved segment 1*c* extends in a smooth curve from the terminus of segment 1*b* for a distance of 30-35% of the overall length of the handle. Segment 1*c* optimally has a uniform radius of curvature $R_2$ (measured from $C_2$, the center of the circle of $R_2$) of approximately one-third the length of the handle. The primary longitudinal axis of segment 1*c* approaches, but is not parallel to, the ground surface on which the working attachment to which the handle is to be connected is used.

For instance, an exemplar handle with an overall length of sixty inches, would have a straight segment 1*a* with a length of approximately ten and a half inches, a curved first segment 1*b* with a length of approximately thirty inches and a radius of curvature of 120 inches, and a curved second segment 1*c* with a length of approximately nineteen and a half inches and a radius of curvature of seventy-eight inches. A handle of these dimensions is disclosed merely for illustrative purposes. The handle of the present invention is not to be considered restricted to these or correspondingly proportional dimensions.

Figure 2:
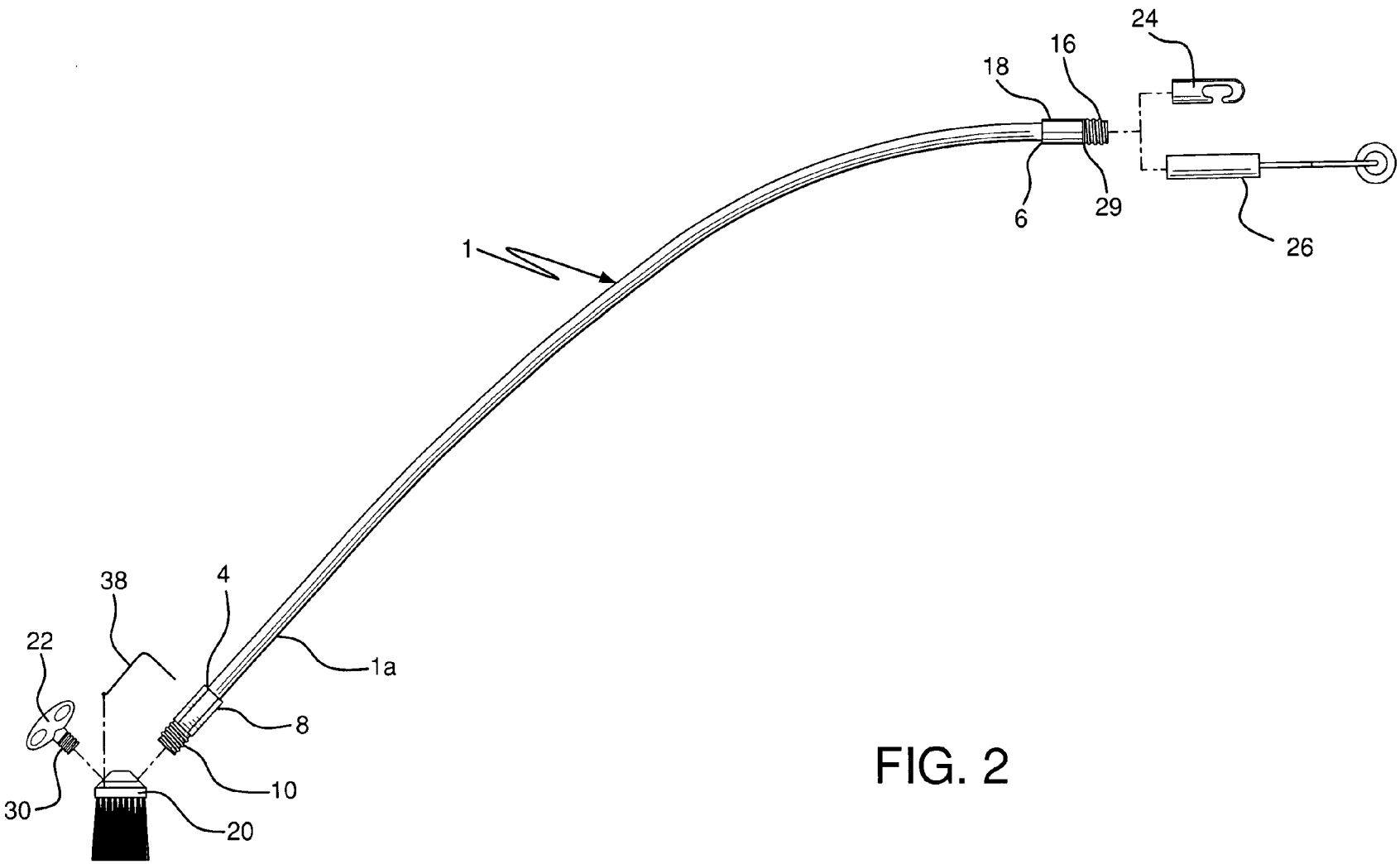
FIG. 2 is an exploded elevation view of a manually operated implement, a pushbroom, employing the curved handle of the present invention with a pushbroom head.

Handle 1 has the versatility to be used with attachments at either working end 4 or 6. FIG. 2 shows the components, pushbroom head 20 and locking nut 22, which would be used when handle 1 is employed as a pushbroom at end 4. It is contemplated that any type of attachment directed towards cleaning or other working application on a ground, floor or other horizontal surface, e.g. a floor squeegee, sponge or dust mop, roller mop, floor roller for applying adhesives and solvents etc., can be connected to end 4.

FIG. 2 also depicts a cleaning or other type of working member or attachment, such as wall sponge 26, configured to be secured at end 6, to be used on vertical and elevated surfaces. Such attachments could include a wall squeegee, paint roller, sheetrock sander, scrub brush, and the like.

Figure 3:
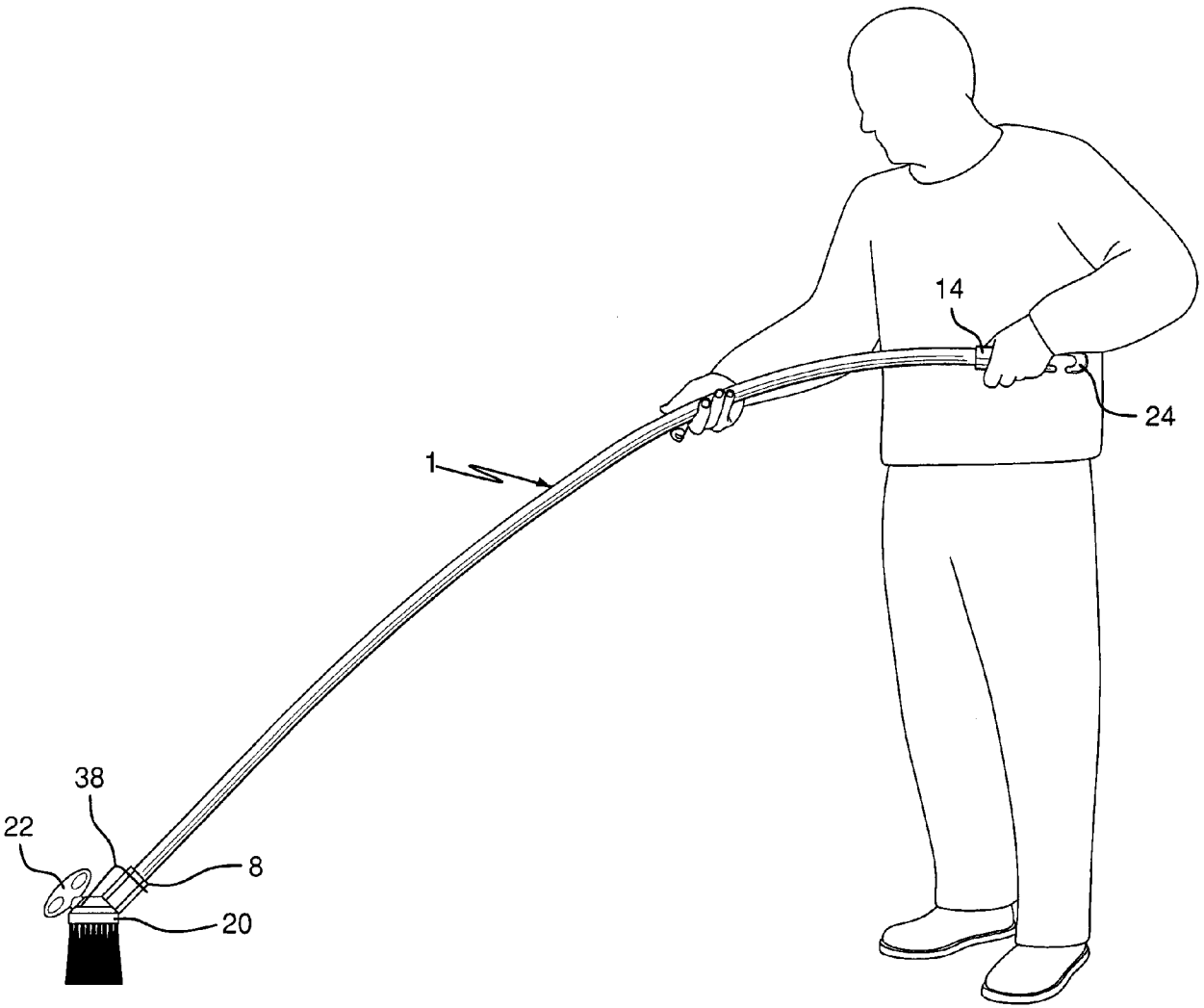
FIG. 3 is an elevation view of an assembled manually operated implement, a pushbroom, employing the curved handle of the present invention with a pushbroom head.
Figure 6:
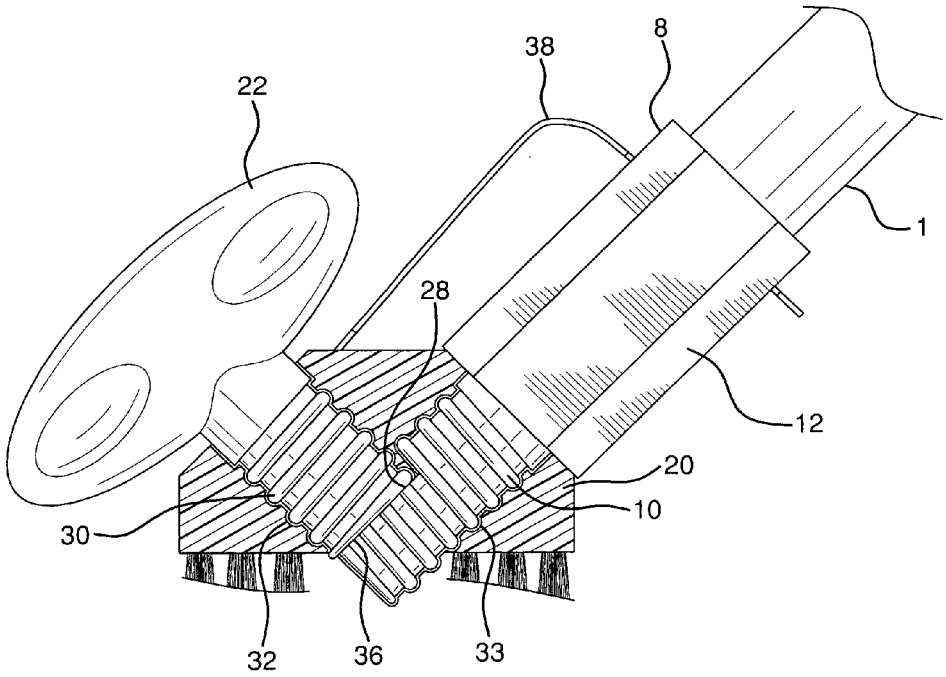
FIG. 6 is a cross-sectional elevation view showing the manner of locking connection between the handle of the present invention and a working attachment such as a pushbroom head.

In the assembled pushbroom mode, shown in FIG. 3, pushbroom head 20 is secured to handle 1 via threaded end 10, shown in FIG. 6, and locking bracket 38. It is contemplated that locking bracket 38 would be similar to that which is described in U.S. Pat. No. 5,502,862. Locking nut 22 is provided to further secure the connection.

Figure 5:
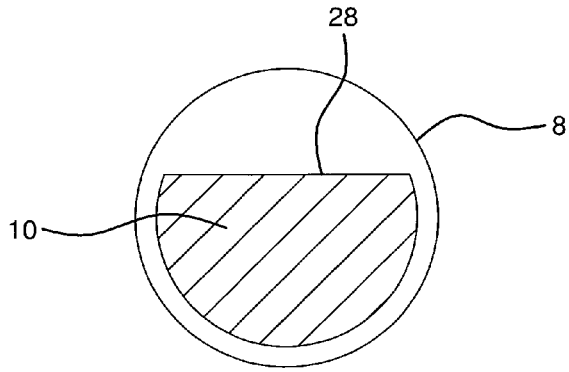
FIG. 5 is a cross-section view taken from FIG. 1.

FIG. 5, a cross-section of connector 8 taken from FIG. 1, shows flat surface 28 on threaded end 10. Locking nut 22 comprises threads 30 which screw into corresponding threads 32 in pushbroom head 20. Bottom surface 36 of locking nut 22 is also flat. When threaded end 10 of connector 8, configured to be screwed into corresponding threads 33 of pushbroom head 20, is fully threadably secured within the head, locking nut 22 is subsequently screwed into the head such that its flat bottom surface 36 contacts flat surface 28 of the threaded end. Tightening locking nut 22 against flat surface 28 provides an added, significant locking feature between handle 1 and head 20, which may be used with or without pushbroom locking bracket 38. As a practical matter, tightening locking nut 22 onto flat surface 28 provides a necessary locking means which ensures for a stable handle to head connection, not otherwise available.

Figure 7:
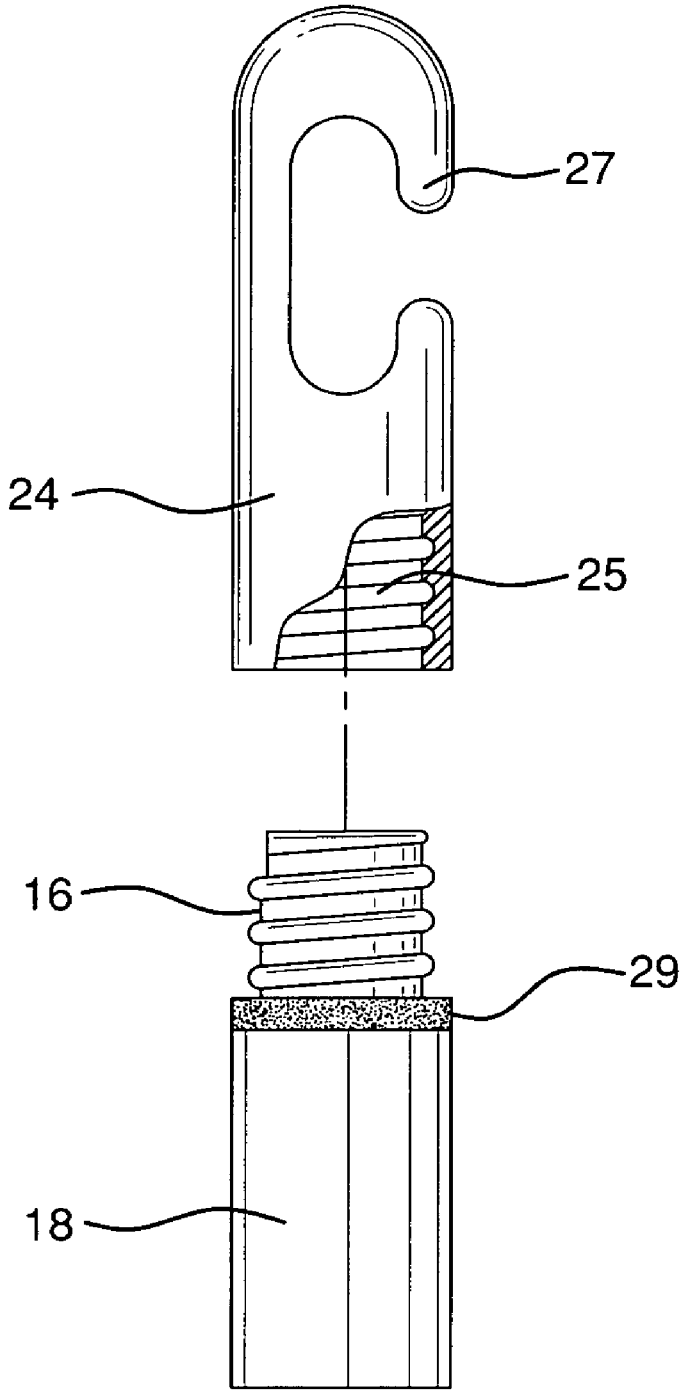
FIG. 7 is an elevation view, in partial section, showing the sleeve and cover at the end of the handle of the present invention.

As best seen in FIG. 7, removable connector cover 24 is cylindrical, corresponding to the cylindrical shape of sleeve 18 of connector 14. Cover 24 has internal threads 25 which are configured to be threadably engaged with threaded end 16 of connector 14 to protect the threads and to provide for the comfort of the user. Compressible rubber or plastic O-ring 29 is positioned over the end of sleeve 18, so that when cover 24 is tightened onto threaded end 16, it squeezes O-ring 29 against the cylindrical sleeve, presenting a sealed and seamless fit. Base section of working attachment 26 configured to be secured to end 6 of handle 1, has internal threading similar to cover 24, so as to be threadably engaged against sleeve 18 and sealed via O-ring 29.

Cover 24 comprises open hooked eyelet section 27. Eyelet section 27 not only permits handle 1 to be hung for storage when a working attachment is secured to end 4, but it also serves as a convenient hook component for reaching elevated areas where objects which otherwise may be out of reach can be retrieved.

The configuration of handle 1, when employed on a pushbroom head or similar pushing implement, provides the user with an ergonomic tool which is quite effective in cleaning operations. As seen in FIG. 3, the pushing force applied at end 6 is more efficiently directed forward and downward, due to the connection of pushbroom head 20 to straight segment 1*a* and curved segments 1*b* and 1*c*. In addition, and importantly, the curved configuration of handle 1 provides significant help in relieving back strain of the user, who is now free to assume a more comfortable and normal pushing position by remaining straighter and more upright, as shown in FIG. 3.

Figure 4:
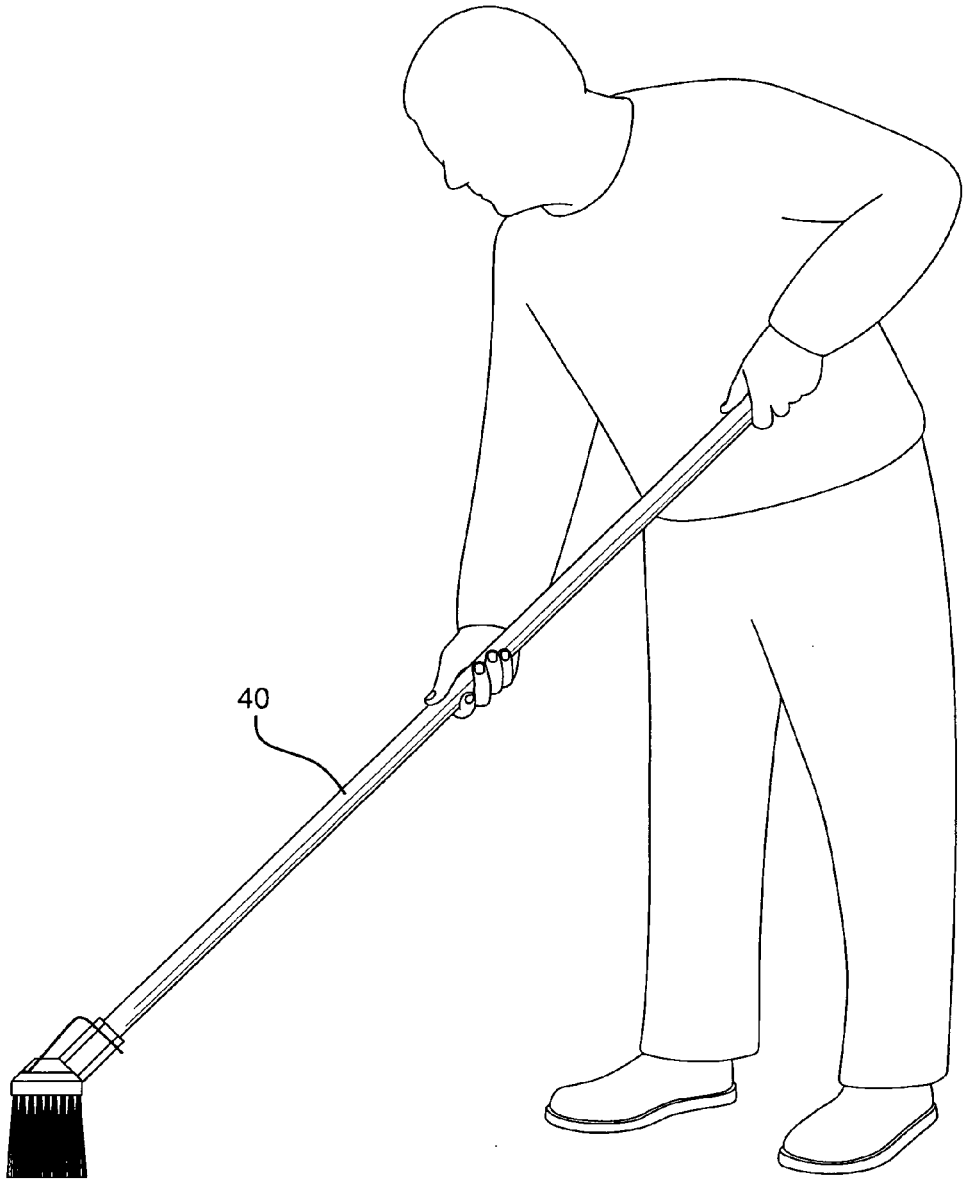
FIG. 4 (Prior Art)
FIG. 4 is an elevation view of a prior art handle secured to a cleaning attachment, a pushbroom head.

This is in contrast to the more awkward, fatiguing body position which is associated with straight handles. FIG. 4 shows the common, representative straight handle 40 in use. The straight, more upwardly extending nature of the handle serves to decrease the effect of the pushing action, making it more difficult for the user, and requiring additional pushing force from a higher, less comfortable, less natural angle. As a result the user must assume more of a crouching position to do the work, thus resulting in increased strain to the back.

As shown in FIG. 2, located at end 6 of handle 1 is working attachment 26 which could be a wall sponge or brush, as discussed above, for cleaning vertical and elevated surfaces. Used in this mode, handle 1 is held around straight segment 1*a*, which provides a ready handle portion, making it easier for the user to grasp and elevate handle 1 and working attachment 26. Handle 1, with its straight segment 1*a*, thus provides a convenient and ergonomic straight handle portion, on handle 1 itself, to allow a user to easily hold and control the implement when it is to be elevated.

In addition, handle 1 of the present invention, when used on vertical and elevated surfaces, overcomes obstacles which straight handles do not address. The curvature of the handle creates increased leverage and thus allows for increased pressure on the work surface. The curvature also creates space between the user and the work surface. This is especially helpful when working overhead to keep debris from falling on the user, thus generally promoting a cleaner and safe work environment.

The disclosure herein, while it is directed to a handle with a shaft having a straight segment and two segments which comprise a smoothly curved, continuously concave section, is not to be considered as to be restrictive of the scope of the herein invention. For instance, depending on the desired angular curve on the handle, it is contemplated that the handle of the present invention may be configured with more than two curved segments with different radii of curvature, in order to make up the full length of the curved, concave section. The exact curvature or radius of curvature of each segment is also not to be considered limited to the herein disclosure.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A handle for a manually operated implement comprising:

an elongated, continuous shaft having a given length and a first end and a second end, said shaft comprising a substantially straight segment and a smoothly curved concave section continually rounded inward over the entire length of the section, said curved concave section comprising a first curved segment with a first uniform first radius of curvature, the center of the circle of said first radius of curvature being on the concave side of the shaft, and a second curved segment with a second uniform radius of curvature, the center of the circle of said second radius of curvature being on the same concave side of the shaft as the center of the circle of the first radius of curvature of said first curved segment, the straight segment beginning at the first end of the shaft and extending less than half the length of the shaft, and the curved section beginning at the second end of the shaft and extending to the straight segment; and means on one of the two ends of the shaft to attach a working member.

2. The handle as in claim 1 wherein the straight segment comprises between fifteen and twenty percent of the length of the shaft.

3. The handle as in claim 1 wherein the first radius of curvature of the first segment is substantially two times the length of the shaft.

4. The handle as in claim 1 wherein the first radius of curvature of the first curved segment is greater than the second radius of curvature of the second curved segment.

5. The handle as in claim 4 wherein the straight segment comprises between fifteen and twenty percent of the length of the shaft.

6. The handle as in claim 1 wherein the straight segment comprises between fifteen and twenty percent of the length of the shaft.

7. The handle as in claim 1 further comprising second means on the other of the two ends of the shaft to attach a working member.

8. The handle as in claim 1 wherein the attaching means comprises a threaded connection having a substantially flat surface means for receiving a compressive force from a connector element.

9. The handle as in claim 1 wherein the working member is attached to either the first or second end of the shaft.

10. The handle as in claim 1 further comprising a cover member with threaded means for connection to at least one end of the shaft.

11. The handle as in claim 10 further comprising second means on the other of the two ends of the shaft to attach a working member.

12. A handle for a manually operated implement comprising:

an elongated, continuous shaft having a given length and a first end and a second end, said shaft comprising a substantially straight segment, a first curved segment having a first uniform radius of curvature, and a second curved segment having a second uniform radius of curvature, said first and second curved segments forming a smoothly curved concave section continually rounded inward over the entire length of the section, the straight segment beginning at the first end of the shaft and extending less than half the length of the shaft, said first curved segment beginning at the terminus of the straight segment and extending to the second curved segment, the second curved segment beginning at the terminus of the first curved segment and extending to the second end of the shaft; and means on one of the two ends of the shaft to attach a working member.

13. The handle as in claim 12 wherein the straight segment comprises between fifteen and twenty percent of the length of the shaft.

14. The handle as in claim 12 wherein the first radius of curvature of the first curved segment is substantially two times the length of the shaft.

15. The handle as in claim 12 wherein the first radius of curvature of the first curved segment is greater than the second radius of curvature of the second curved segment.

16. The handle as in claim 12 wherein the attaching means comprises a threaded connection having a substantially flat surface means for receiving a compressive force from a connector element.

17. The handle as in claim 12 wherein the working member is attached to either the first or second end of the shaft.

18. The handle as in claim 12 further comprising a cover member with threaded means for connection to at least one end of the shaft.

19. The handle as in claim 12 wherein the center of the circle of the first radius of curvature of the first curved segment is on the concave side of the shaft and the center of the circle of the first radius of curvature of the second curved segment is on the same concave side of the shaft as the center of the circle of the first radius of curvature of said first curved segment.

* * * * *